United States Patent [19]

Egli et al.

[11] Patent Number: 4,723,712

[45] Date of Patent: Feb. 9, 1988

[54] VARIABLE COLORANT BLENDER

[75] Inventors: Jean Egli, Winkelriedstrasse 26, 3014 Bern; Marc Heyraud, La Chaux-de-Fonds, both of Switzerland

[73] Assignee: Jean Egli, Bern, Switzerland

[21] Appl. No.: 852,816

[22] Filed: Apr. 16, 1986

[30] Foreign Application Priority Data

May 13, 1985 [CH] Switzerland ..... 2028/85
Mar. 10, 1986 [EP] European Pat. Off. ..... 86103182.1

[51] Int. Cl.[4] ..... B43K 27/00

[52] U.S. Cl. ..... 239/307; 137/240; 137/606; 137/893; 137/897; 239/61; 239/112; 239/412; 239/413

[58] Field of Search ..... 239/112, 113, 304, 307, 239/410, 411, 412, 413, 416.1, 61; 137/240, 606, 897, 893, 894

[56] References Cited

U.S. PATENT DOCUMENTS

| | | | |
|---|---|---|---|
| 3,201,048 | 8/1965 | Gibbs | 239/411 X |
| 3,348,774 | 10/1967 | Wiggins | 239/112 X |
| 3,373,762 | 3/1968 | Korchak | 239/112 X |
| 3,572,366 | 3/1971 | Wiggins | 137/606 X |
| 3,670,768 | 6/1972 | Griswold | 137/606 |
| 3,672,570 | 6/1972 | Scarbrough et al. | 239/112 X |
| 3,674,205 | 7/1972 | Kock | 239/112 X |
| 4,163,523 | 8/1979 | Vincent | 239/112 X |
| 4,215,721 | 8/1980 | Hetherington et al. | 239/112 X |
| 4,231,392 | 11/1980 | Allibert | 137/606 X |
| 4,306,587 | 12/1981 | Tchebinyayeff | 137/606 |
| 4,546,922 | 10/1985 | Thometz | 239/304 |
| 4,558,845 | 12/1985 | Hunkapillar | 137/606 X |
| 4,597,412 | 7/1986 | Stark | 137/606 |

*Primary Examiner*—Gerald A. Michalsky
*Attorney, Agent, or Firm*—Werner W. Kleeman

[57] ABSTRACT

A variable colorant blender is provided for use as adjunct to an airbrush (A) or other spray gun. It includes a plurality of metering valves or similar devices which are actuatable wholly independently of one another for enabling the user to obtain and continuously change any colorant blend and also to perform a rapid rinsing. In preferred embodiments electric metering valve actuators are provided, which are energized by electronic circuit means contained in a control box (16) remote from that portion (10) of the blender which is affixed to the airbrush or other spray gun in replacement of the usual colorant-containing vessel 1, such control box having slides (41) for presetting and changing the proportions of colorants in the discharged blend, and possibly also a push-button (42) for controlling the amount of cleaning liquid (solvent).

12 Claims, 16 Drawing Figures

VARIABLE COLORANT BLENDER

TECHNICAL FIELD

The present invention relates to a variable colorant blender for use with a painting apparatus for discharging colorant, such colorant blender comprising a plurality of discrete supply containers for different individual colorants, means defining a plurality of supply paths connected to receive the individual colorants from the plurality of supply containers, respectively, said supply paths having supply outlet openings, colorant pick-up means defining a common pathway to the painting apparatus and adjustable means adapted to receive the individual colorants and to perform on them a metering action before being mixed and delivered to said pick-up means.

BACKGROUND ART

A variable color blender of this type is already known from U.S. Pat. No. 4,508,271. This prior art colorant blender must be considered as a substantial progress in the art of airbrushes considering that this art has remained stagnant during decades (as follows from "The Airbrush Book, Art, History and Technique", ISBN 3-7701-1475-2) although the use of airbrushes has enormously increased. More particularly, the inventor of this known colorant blender has recognized the urgent need for an instrument to be associated with an airbrush utilizing a multiplicity of color materials without requiring interruption in order to change containers, which furthermore minimizes the plugging of paint and air holes, and which also does not have to be cleaned out to add black, white or solvent materials. However, all the embodiments of the colorant blender illustrated and described in the above-mentioned prior art still have many drawbacks. An important one of these drawbacks results from the basic idea of mechanically providing adjacent holes assigned to spectrally adjacent colors and with which a passage in a rotatable pick-up member can be brought in register, if desired with some overlap for two adjacent such holes. As a consequence of such construction only two spectrally adjacent colors can be blended with this known color blender. In a more elaborate embodiment the provision of a supplementary set of holes and of a complementary pick-up permits to additionally obtain "intense" grays and charcoals by admixing complementary colorants, for example orange and blue. Also in a still more elaborate embodiment additional holes merging into respective concentrical grooves are provided, from which a white and a black colorant and a solvent can flow to a respective push valve to be ultimately mixed with a blend of two spectrally adjacent colors before the resultant mixture reaches the airbrush. But even so the possibilities of this known colorant blender are limited by the fact that still only two spectrally adjacent colors (eventually with black or white added) can be blended, and that they can be blended only in a predetermined, invariable relation.

A plurality of embodiments of variable colorant blenders of the kind initially defined hereabove and mounted onto a paint spray gun are illustrated and described in the EP-A No. 125 966. In one embodiment three supply flowpaths sucking different individual colorants from respective bottles merge in respective outlet holes provided in a uniform angular distribution in a fixed disk. These holes can pairwise be brought into more or less precise register with an arcuate groove provided in one face of a rotatable valve plate. The arcuate groove has a depth augmenting from a zero value at both ends to a maximum value in the vicinity of the middle of its length where the groove discharges the colorant or blend of colorants to a pick-up hole communicating with passageways of the paint spray gun and ultimately with the spray nozzle of that gun. Owing to such arrangement the user has the choice by adequately positioning the rotatable valve plate, to supply the spray gun, via said pick-up hole, either with one colorant or with a variable blend of two of the three colorants contained in the three bottles. In a more elaborate embodiments described with reference to FIGS. 8 to 10 of said European patent application the valving end portions of three axially movable valve members act in narrowings of the three supply holes to which they are individually assigned. A spring acts onto the enlarged rear end portion of each valve member to press it against a cam end face of a manually rotatable control ring. The cam end face is so shaped that in either one of three positions of the control ring two of the three valve members are held in closing position while the third valve member is allowed to occupy its fully open position. When the control ring is turned in either direction from that position, the third valve member gradually closes the narrowing to which it is assigned, while one of the first mentioned two valve members is kept in closed position whereas the other one is permitted to gradually open the narrowing to which it is assigned. Thus, the user has the choise to spray either one of three colorants or a blend of two colorants which he can vary between two extremes. Thus in this last depicted embodiment the three valve members, if considered for them alone, are "movable independently from one another". However, since they are always pressed by their spring against the cam end face of the control ring their action is not in fact independent from one another but, on the contrary, tied to one another by the control ring. Therefore, as a matter of fact, the situation or result is about the same as if in the simpler embodiment described in the afore-mentioned U.S. Pat. No. 4,508,271 there would be provided only three supply holes for three colorants. Clearly, as is the case with the colorant blenders known from U.S. Pat. No. 4,508,271, with the construction of EP-A No. 125 966 only two spectrally adjacent colors can be blended, and this only in a predetermined, unvariable relation.

SUMMARY OF THE INVENTION

A primary object of the present invention consists in doing away with this main drawback of the known colorant blenders. In formal respects the subject of the present invention can be considered to be an improvement, more particularly, of the colorant blender disclosed in EP-A No. 125 966 since the latter has already the valve members which, per se, are movable independently of one another.

The primary improvement, as afforded by the present invention, consists in that said adjustable means comprise a plurality of metering valves having each an inlet individually connected to one of said supply-outlet openings and including each a movable member in combination with means for actuating these valve members such that each of these valve members is movable wholly independently of the other ones.

Quite optionally the present invention provides, in its embodiments, a plurality of further major improvements which render the new colorant blender particularly well suited to serve as an adjunct more especially of an airbrush, but equally valuable as an adjunct to larger paint spraying guns.

In one preferred embodiment the colorant blender of the present invention has a housing that is common to all metering valves (six of these are typically provided) and it is so small and lightweighted that it can easily be coupled to, and used on, an existing airbrush the body of which has the usual lateral socket usually serving for coupling to it a colorant-containing vessel. In such a housing the longitudinal axes of valve needles constituting the movable valve members of the metering valves preferably converge to a point in a mixing chamber located downstream of the seats of the metering valves as do the lateral edges of an upright pyramid the basis of which has the shape of a regular polygon (which is a hexagon if six metering valves are provided, typically three for the primary colors red, blue and yellow, plus two for the black and the white plus one for a solvent). In this embodiment the housing also contains electric actuators for the valve needles of the metering valves. Preferably, these actuators are solenoids each also coacting with a closing spring. The electromagnetic valve assemblies thus provided are of the known type (see for example those used in gasoline injection systems of modern i.c. engines) which are energized by current pulses determinating their alternating opening and closing times in a rapid succession, those pulses being supplied by electronic circuit means in a control box placed at a location remote of the airbrush-and-blender assembly. Such control box may then include color selector slides acting on potentiometers or linear encoders or similar means for position sensing included in the electronic circuit means, whereby a user is enabled to preset and to continually vary color blends with the fingers of one of his hands while with his other hand he works with the airbrush as usual. Such arrangement enables the user to keep excellent control on the airbrush. Moreover the momentarily obtained blend of colorants has a very short distance to flow from the mixing chamber, which is provided in the housing common to all metering valves, to the airbrush. As a result thereof the time period lapsing between a change of the color selection and the effective change of the colorant blend discharged by the airbrush is very short. A further result is that the quantity of colorant blend to be discharged as a waste before a rinsing of the mixing chamber and of the flowpaths downstream of same can be effected is small since such can be carried out simply by producing a prolonged opening of that valve of the colorant blender which is assigned to the solvent used as cleaning liquid.

The invention furthermore provides an embodiment in which the electronic control is replaced with a hydraulic control; in this connection a control unit will be described which is ergonometric insofar as it responds to finger pressure. A control blocking is then also provided which permits to block a selected setting for any one of the colorants while changing the setting of other colorants.

These and other objects and particularities of the present invention, together with further advantages thereof, will be better understood from the following description in connection with the accompanying drawings in which several embodiments of the invention are illustrated by way of example. It is to be expressly understood, however, that the drawings are for purposes of illustration and description only and are not intended as a definition of the limits of the invention.

DESCRIPTION OF EMBODIMENT

Figure 1:
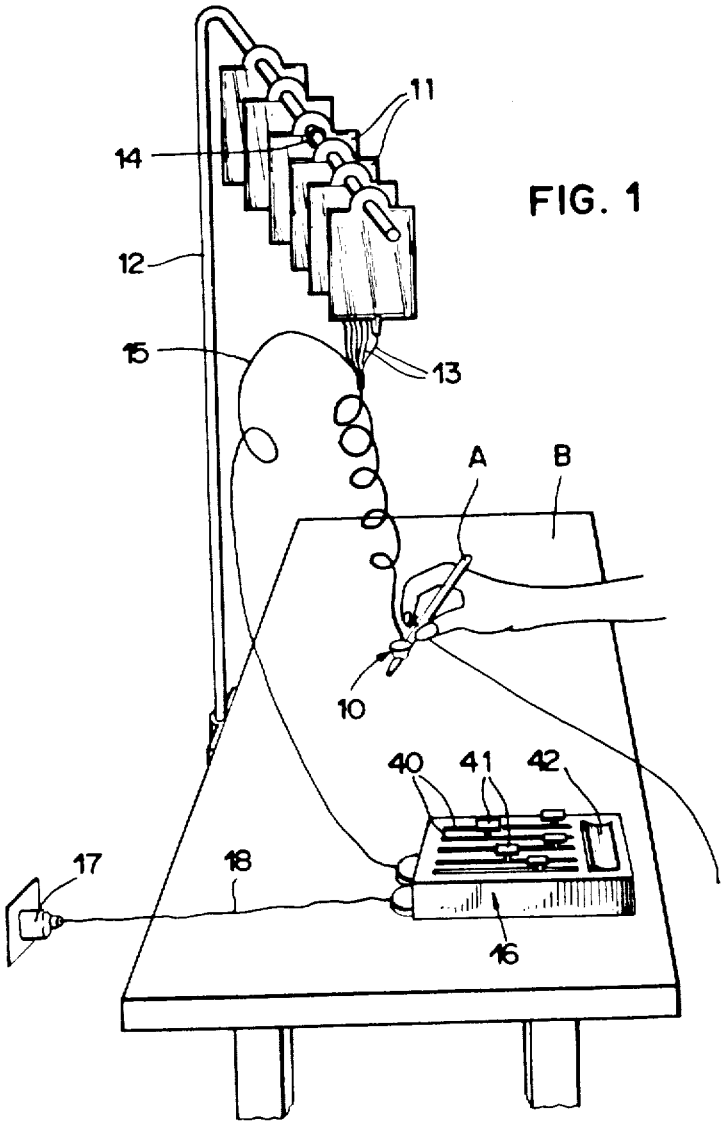
FIG. 1 is a perspective view of a first embodiment of the colorant blender of the invention, a main sub-assembly of which is affixed to an airbrush in replacement of the usual colorant-containing vessel.
Figure 2:
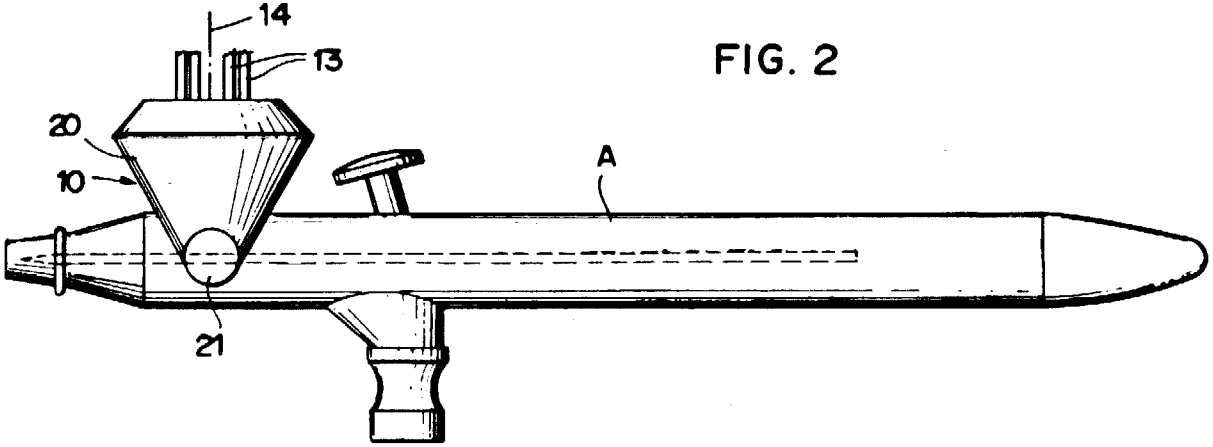
FIG. 2 is an elevational view of the airbrush of FIG. 1 and affixed sub-assembly.
Figure 3:
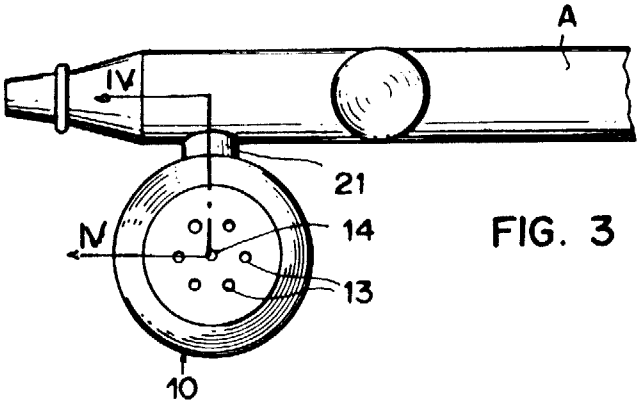
FIG. 3 is a plan view of the airbrush of FIG. 1 and affixed sub-assembly.

Turning first to FIG. 1 reference A designates an ordinary airbrush while reference B designates a work table. Reference 10 denotes a main sub-assembly pertaining to the colorant blender, such sub-assembly 10 being affixed to the body of the airbrush A in a manner to be described later on. Reference 11 designates bags made of flexible sheet material resisting to the solvents present in atomizable colorants; these bags 11 are shown to be suspended from a support 12 having a foot (not shown) resting on the same floor as the feet of the work table B. The bags 11 are connected by flexible holes 13 (having a very small diameter) to a housing 20,21 (FIG.

4) pertaining to sub-assembly 10. As will be described in more detail below this housing 20,21 is attached to the lower end portion of a helical spring wire 14 the upper end portion of which is attached to support 12 whereby the sub-assembly 10 together with the airbrush A are freely suspended when not in use. The reference numeral 15 denotes a multi- conductor chord which connects electric parts of the sub-assembly 10 to electric parts of a control box 16, still to be described; the control box 16 is connected to a connector 17 and thereby to the net by a cord 18.

Figure 4:
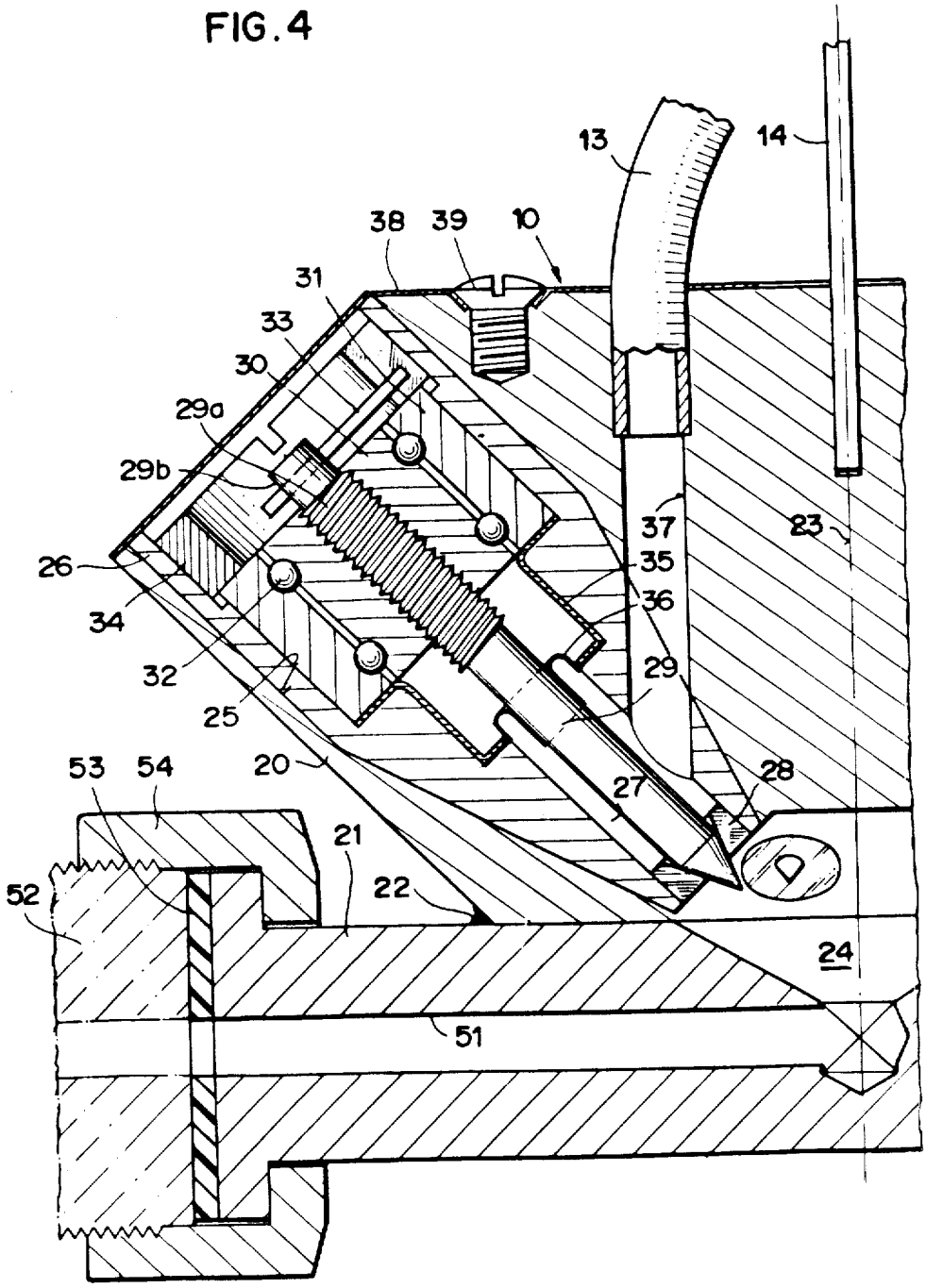
FIG. 4 is a sectional view taken along line IV—IV of FIG. 3, at an enlarged scale.

In the embodiment illustrated in FIG. 4 the sub-assembly 10 includes the already mentioned housing formed of the parts 20 and 21 which are affixed to each other as shown at 22, for instance by welding if these parts are made of steel. Housing part 20 is of circular cross-section with its longitudinal axis shown at 23. The part-cylindrical bottom surface of housing part 20 matches with the cylindrical outer surface of housing part 21. The two housing parts 20,21 together delimit a mixing chamber 24 having conical truncated walls. Housing part 20 has six partly cylindrical and partly conical bores 25 the axes of which converge to a point located in the mixing chamber 24 as do the lateral edges of an upright pyramid having as basis a regular hexagon; each of these bores 25 lodges a shell 26 having a staggered or stepped cylindrical bore 27. The narrowest portion of this bore merges into the mixing chamber 24 and lodges a valve seat ring 28 preferably made of synthetic sapphire or similar hard material; on a part of its length the conical bore of valve seat ring 28 constitutes the seating of a metering valve having as movable valve member a needle 29 with a coaxial rear extension 29*a* provided with an external threading of high accurateness and small pitch; this threading cooperates with a complementary internal threading provided in the central bore of the rotor 30 of a miniature step motor the stator of which is designated by 31. The reference numeral 32 denotes ball bearings by means of which the rotor 30 is rotatably supported in the stator 31 without any axial or radial play. The rearmost cylindrical extension 29*b* of the valve needle 29 has a diametrically extending bore fixedly holding a pin 33 whose one end portion can glide without substantial play in a longitudinal slit provided in a ring 34 press-fitted in the rearmost and widest portion of the staggered or stepped cylindrical bore 27. Thus the valve needle 29 is held against rotary motion especially during rotary motions of the rotor 30 in either direction. A thin-walled sleeve 35 serves to retain a flange portion of a still thinner and very flexible sealing sleeve 36, the innermost cylindrical portion of which sealingly surrounds the valve needle 29 as shown. Any other low-friction sealing could be provided. Very low friction conditions must prevail in that sealing device and also in the screwing connection between valve needle 29 and rotor 30, in the ball bearings 32 and also in the guiding of pin 33 in the longitudinal slit of ring 34 in view of the very small torque delivered by a miniature step motor as is provided for the presently described colorant blender, such motor typically having an outer diameter of approximately 7 mm.

The portion of the staggered or stepped cylindrical bore 27 that is located immediately behind the valve seat member 28 is in open connection with a bore 37 the axis of which is parallel to the main axis 23. The slightly enlarged outer end portion of bore 37 sealingly receives one end portion of olne of the flexible hoses 13, whereby that portion of the ducting which is upstream of the valve seat is always in free flow connection with the colorant-containing interior of the bag 11 assigned to that particular metering valve.

The reference numeral 38 denotes a cover made of pressed sheet-metal and affixed to housing part 20 by means of screws 39.

Figure 5:
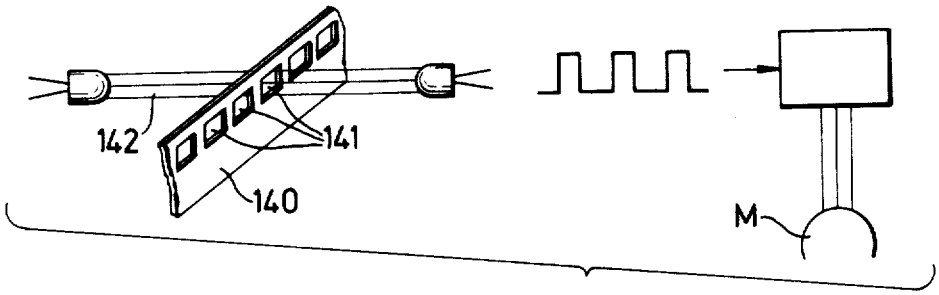
FIG. 5 is a diagrammatical view of an electric current pulse generator energizing a step motor appearing in FIG. 4.

As can be seen from FIG. 1 the covering portion of the control box 16 has five parallel slots 40 from which emerge slides 41 constituting selector members. The control box 16 is also equipped with a press-button 42. The slides 41 are intended to be moved with the fingers of one of the hands of a user who may thereby act on the press-button 42 with the palm of the same hand. The slides 41 and the press-button 42 constitute selector members respectively operatively connected to six electric current pulse generators used to energize a respective one of six step motors as the one 30, 31 of FIG. 4 for rotating the rotor in either direction and correspondingly to axially move the valve needle 29 of the respective metering valve either in opening direction or in closing direction, by an amount commensurate to the latest displacement of the respective slide 41 (or of the press-button 42). Those familiar with the art of electronic control means know that pulse generators producing for example one hundred pulses when the slide 41 is displaced from one extreme position to the other one can be built along different concepts. One of these is diagrammatically illustrated in FIG. 5. In fact this FIG. 5 illustrates a device by means of which it is possible to change at will the character of pulses energizing a step motor M simply by modifying a flux of light, such modification being produced by longitudinally moving a slide 140 provided with a multitude of fine perforations 141 crosswise to a light beam 142. The control is thus realized with a very small inertia. It is thus possible either to accelerate or to decelerate a motor or to reverse its direction of rotation quite immediately and effortlessly.

A colorant blender as described hereinabove, in which the bags 11 contain a red, a blue, a yellow, a black and a white colorant, respectively and one bag a solvent, will discharge one of these colorants (or the solvent) in accordance with the positioning of the slides 41 and/or of the press- button 42, through one or more of the metering valves 28, 29 accordingly regulated, to the mixing chamber 24; the liquid then flows through an axial bore 51 provided in the housing part 21, and then through a coaxial duct provided in the laterally protruding socket 52 of the body of the airbrush A. The housing part 21 has been connected to that socket 52 in replacement of the conventional colorant-containing vessel the connection including a nut 54 and a sealing washer 53. Each time when terminating work the user will advantageously cease the discharge of any colorant and perform at once a rinsing of the mixing chamber 24 and of all flowpaths downstream of that chamber. If the user terminates that rinsing by closing the main valve of the airbrush prior to terminating the discharge of solvent, the chamber 24 and all the flowpaths downstream of same will remain filled with solvent and no plugging of holes can intervene even during long periods of non-use. Similarly, if no solvent can evaporate from the bags 11 or other colorant-containers, the flowpaths upstream of the mixing chamber (or rather upstream of the closures of the metering valves) will remain filled with the liquid colorants (one of them with the solvent) and no plugging will occur in them and the colorants will keep their original viscosity/fluidity.

Instead of the bags 11 made of flexible sheet material which possibly would not resist to solvents as those contained for example in acrylic paints or in nitropaints, it is possible to use as colorant-containers cylinder-and-piston assemblies (similar to medical syringes) made of materials resistant to such more aggressive solvents.

Figure 6:
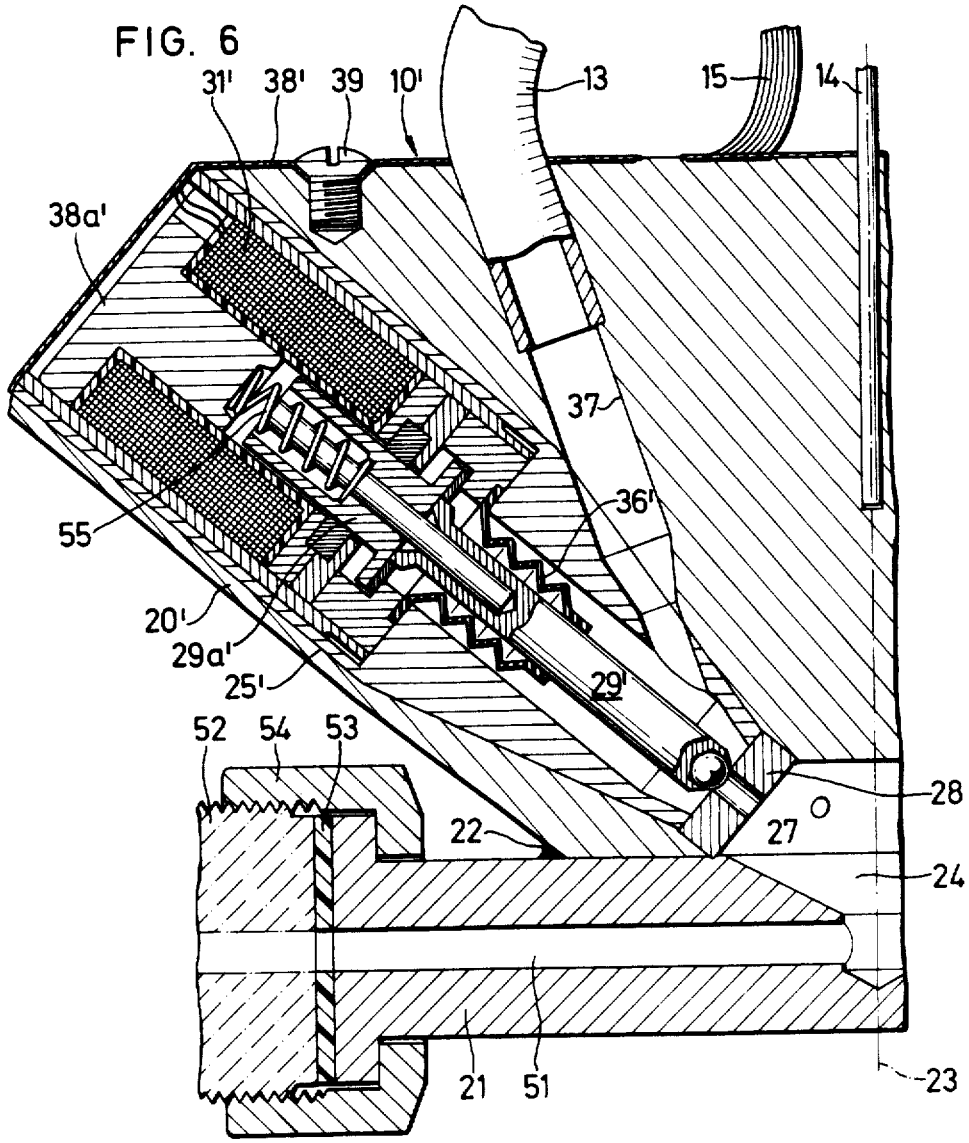
FIG. 6 is a sectional view similar to that of FIG. 4 and showing a preferred modification which includes electromagnetic metering valve and actuator sub-assemblies replacing the metering valve and step motor sub-assembly of FIG. 4.

FIG. 6 illustrates the upper portion of a subassembly 10' which is a modification of sub-assembly 10 of FIG. 4. In this modification the rear portion 29a' of the valve needle 29' constitutes the armature of an electromagnet whose solenoid 31' is lodged in the rear portion of the bore 25' of the housing part 20'. The reference numeral 36' denotes the highly flexible sealing member and the reference numeral 55 designates a closing spring resting on insert 38a' and acting on armature 29a'. The cover 38' is made of an insulating plastic and has on its inside face printed-on conductors connecting the individual conductors of cord 15 with the windings of the solenoids 31'. These solenoids together with their associated armatures 29a' obviously constitute the electric actuators of the valve needles. Again there are provided six assemblies of metering valves and electric actuators in an arrangement similar to that described with reference to FIG. 4. All the actuators are energized by current pulses supplied in a very rapid succession by the electronic circuit means contained in control box 16, the manner of operation being to some extent similar to that of electromagnetic valves and associated electronic control means used in gasoline injection systems of modern i.c. engines. Merely by way of example, and because some sections of these control means may fulfill tasks specific to the assembly of a color blender with an airbrush or other paint spray gun, such control means will now shortly be described with reference to FIGS. 7 to 10.

Obviously the characterising feature of the embodiment of FIG. 6 as compared with the embodiment of FIG. 4, is the way of metering the colorants. Whilst in the embodiment of FIG. 4 metering of the colorants is obtained by a change of the width of aperture, in the modification of FIG. 6 the metering of the colorant is obtained by changing the aperture time. In other words, in the embodiment of FIG. 6 the valve has only two positions viz: fully open or closed. This modification is particularly suited for applications where a number of corrective actions on colorant flow have to be made. Two such corrective actions are indicated hereafter by way of example.

Figure 7:
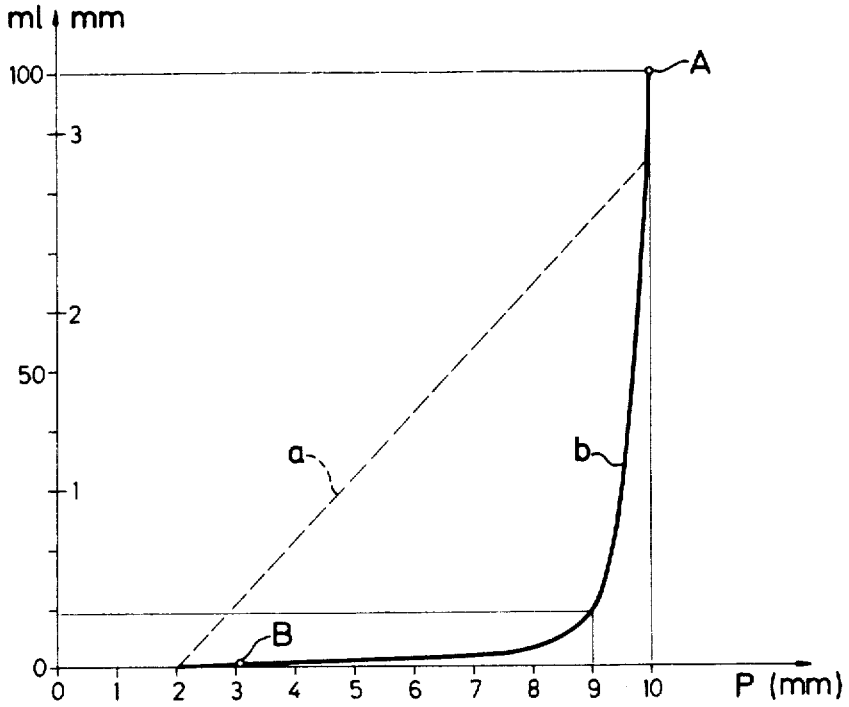
FIG. 7 is a graph showing (a) how the lift of the airbrush needle and (b) how the colorant throughflow varies in function of the motion of said needle.
Figure 8:
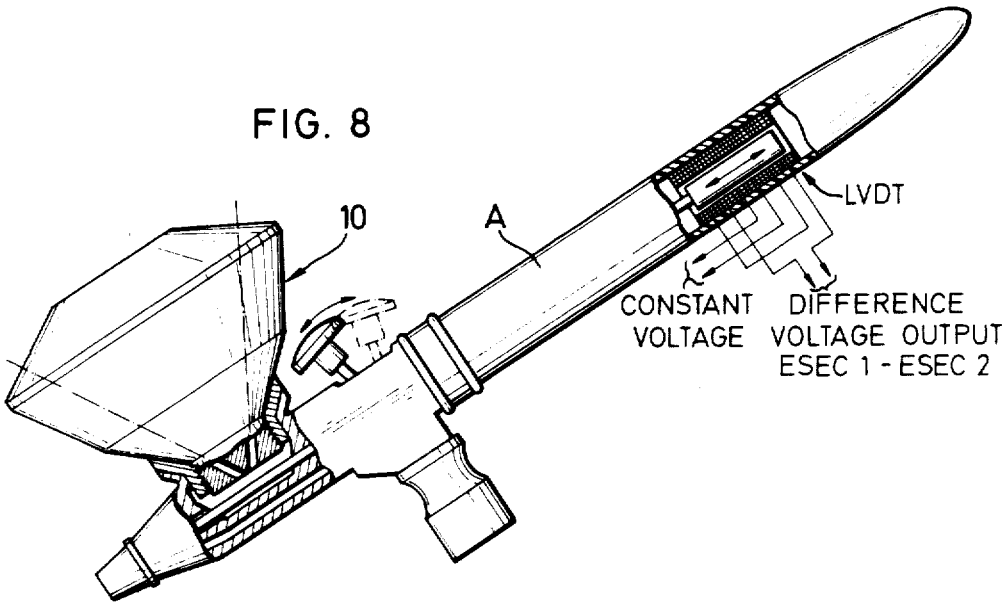
FIG. 8 is an elevational view, partly in longitudinal section of a known airbrush, and illustrating how a colorant blender of the type shown in FIG. 6 (or of the type shown in FIG. 12) is mounted on that airbrush, and also how a transformer serving to deliver a signal representing the motion of the airbrush needle, is mounted in a part of the airbrush housing.

For professional use it is of interest to be able to have a fixed relationship between desired color and positions of the potentiometers, even when there is a change of total blended colorant throughflow, in direct or in variable proportion to the colorant throughflow. One way to achieve this is to sense the position of the main-valve-needle of the airbrush, because there is a measurable relationship between the needle position and the colorant throughflow. An appropriate way of sensing the needle position is with a linear variable differential transformer (LVDT) as such a precise contactless sensor is easy to fit on a commercial airbrush, as shown by FIG. 8. FIG. 7 is a graph illustrating that relationship as measured on an existing airbrush the nozzle of which has a bore diameter of 0.3 mm). In FIG. 7 line a indicates the lift of the valve needle of an airbrush having a nozzle bore of 0.3 mm, while curve b indicates the corresponding colorant throughflow in relation to time. Arrow P indicates the motion of the colorant regulating knob. Point A defines the maximum for covering a surface, while point B shows the point of 0.3 ml throughflow.

Figure 9:
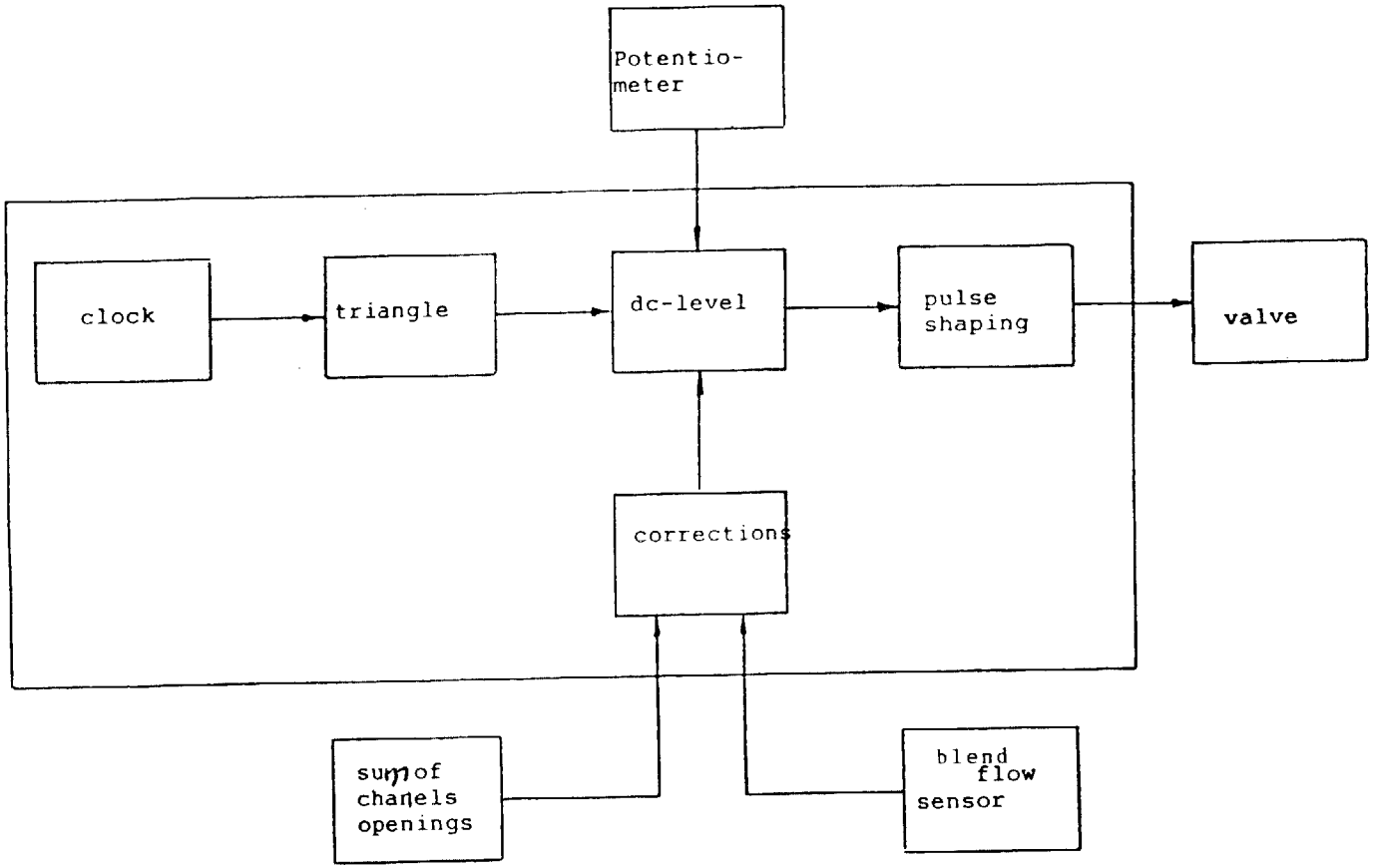
FIG. 9 shows the functional blocks of the control means.
Figure 10:
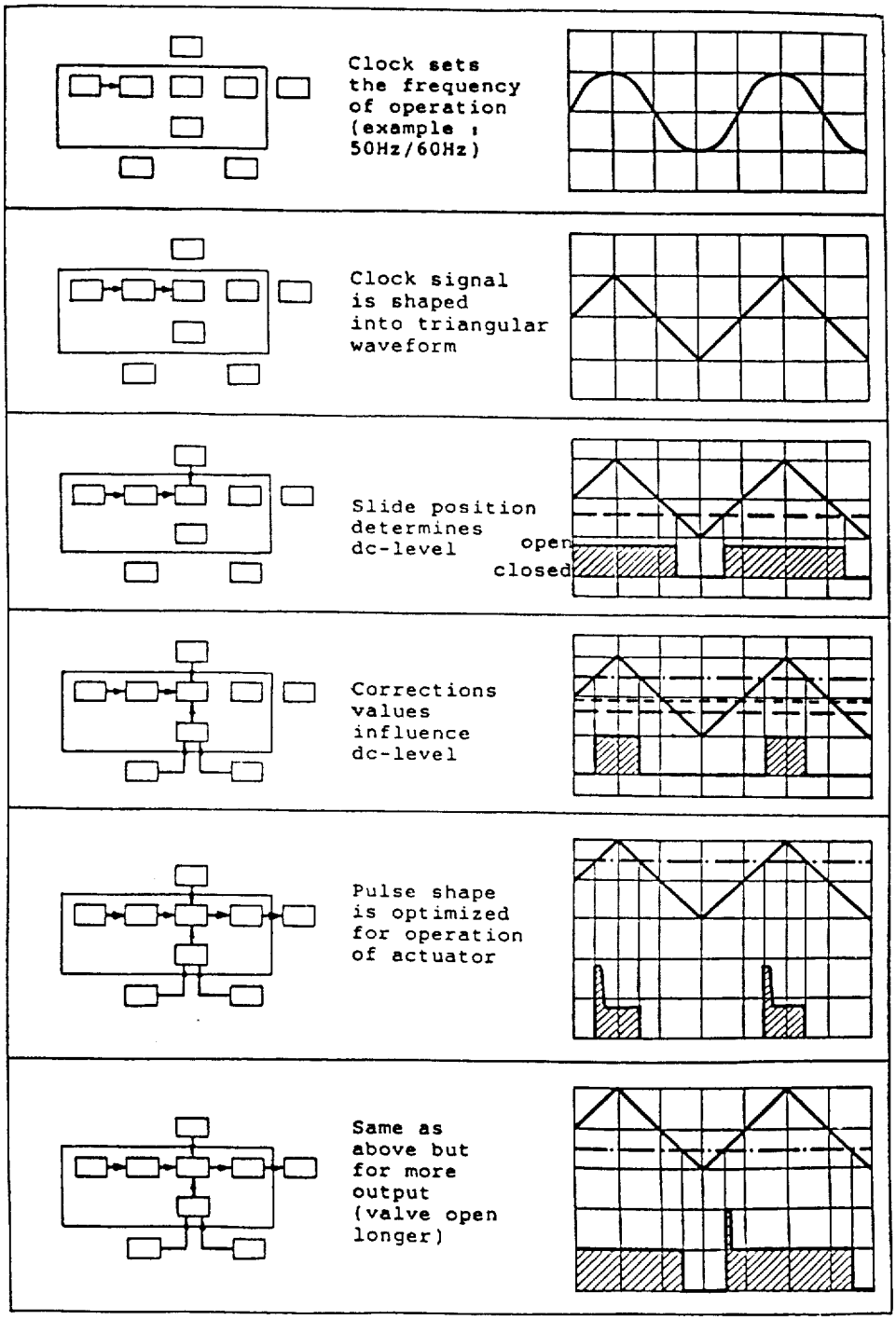
FIG. 10 is a showing of the time sequence of these control means.

Another useful correction is to adjust the colorant flow of each individual metering valve in such a way that the sum of all flows is always equal to say 100%, regardless of the number of metering valves partly or fully open. This can be easily achieved by taking the sum of the voltages across all the potentiometers as a normative term. FIG. 9 shows the functional blocks of the control means, and FIG. 10 explains the time sequence of the control means.

Figure 11:
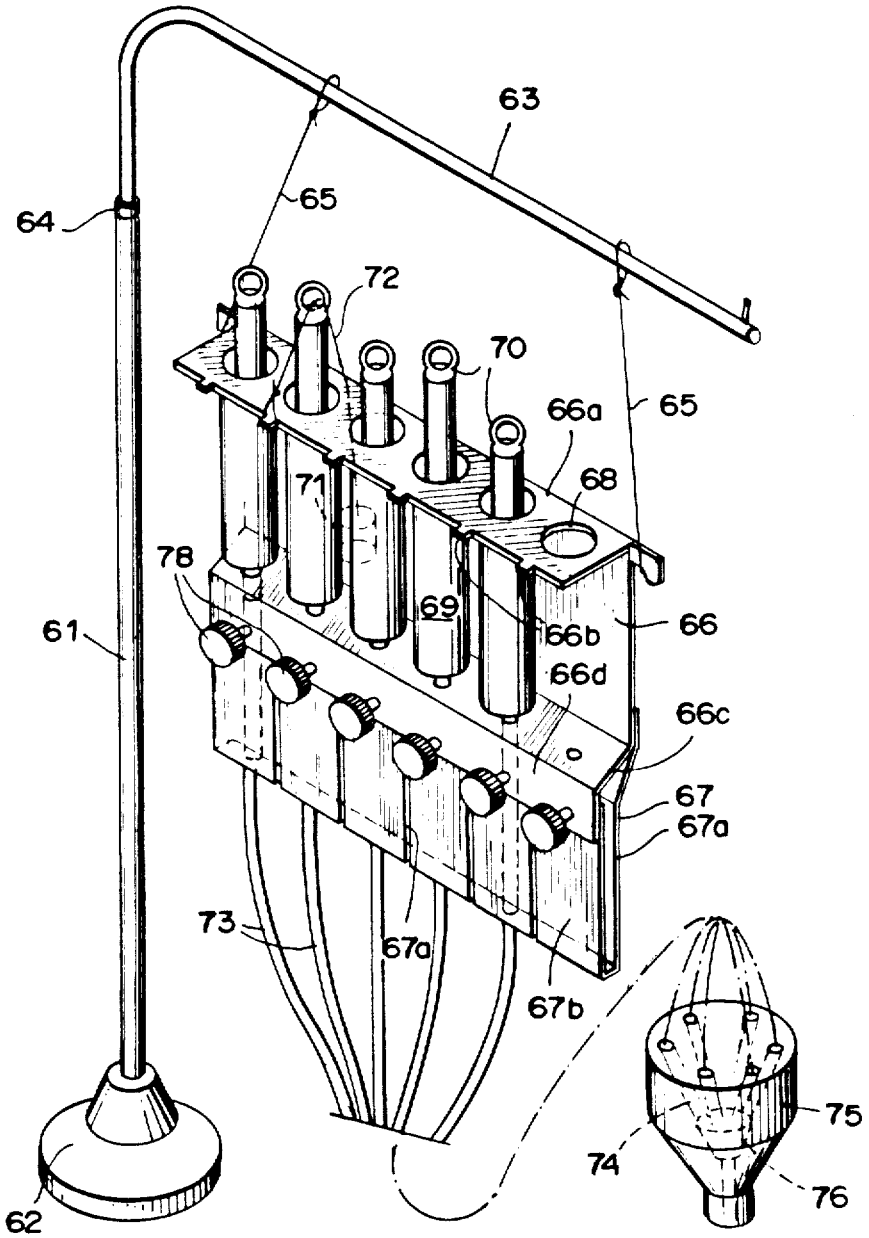
FIG. 11 is a somewhat diagrammatic perspective view of a simplified embodiment of the colorant blender of the present invention.
Figure 12:
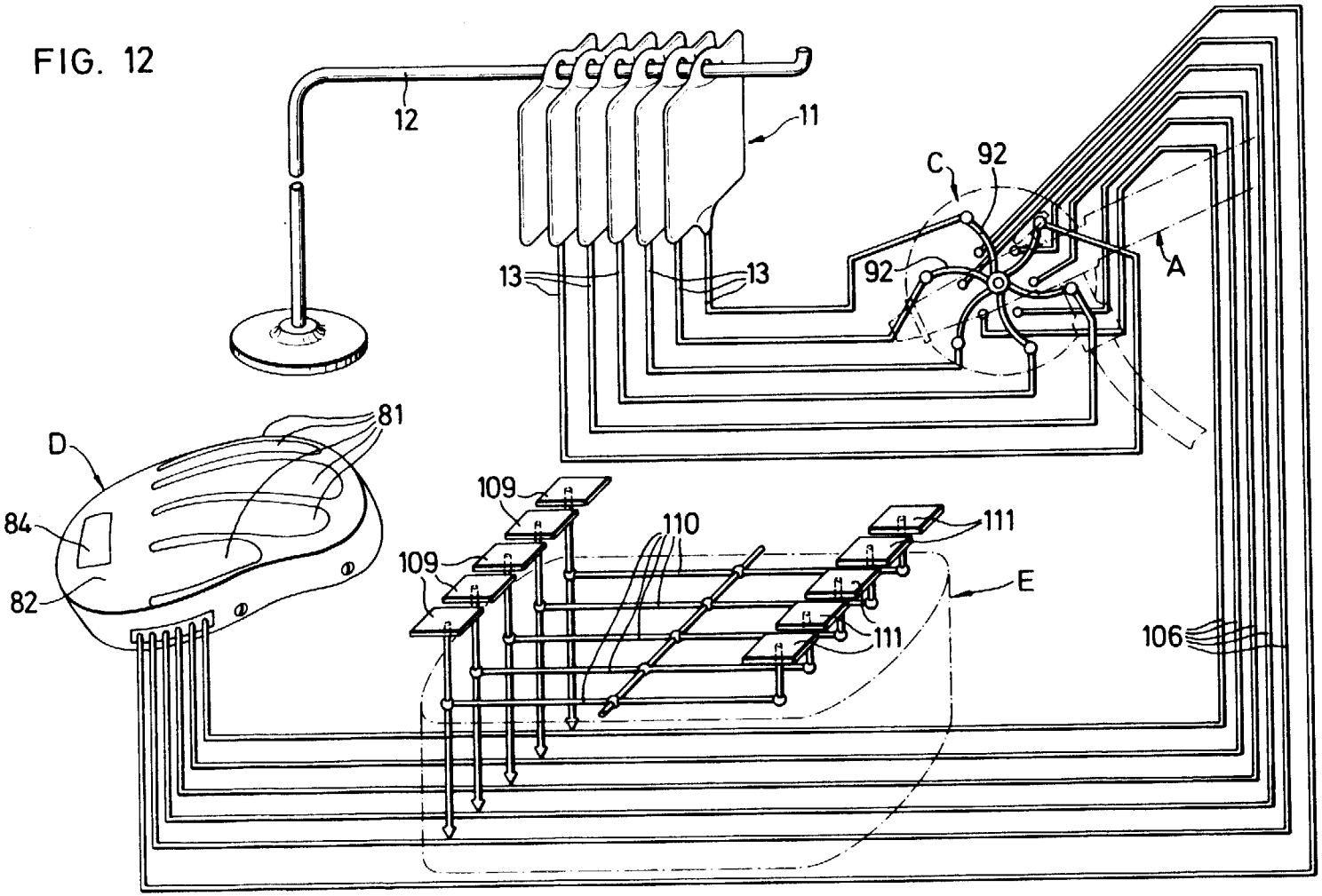
FIG. 12 is a diagrammatic illustration of an embodiment of the invention in which the control of the metering valves in a valve unit mounted on the airbrush for example as shown in FIG. 8 is performed remotely in a hydraulic control unit, a blocking unit being also provided in the bundle of conduit lines connecting that unit with the valve unit.

FIG. 11 illustrates an embodiment of the inventive color blender which may be realized at low costs. This embodiment is rather intended to be used on spray guns with which users make less fine work than with airbrushes. Reference numeral 61 designates a tubular column affixed to a pedestal 62 and 63 denotes an angled support part whose vertical leg can be shifted axially and rotatably in column 61 as soon as a clamping nut 64 has been loosened. A carrier constituted by sheet-metal elements 66, 67 affixed to each other by welding points is suspended to the horizontal leg of support 63 by means of steel wires 65. The elements 66,67 have previously been angled and provided with holes as shown. The horizontal wing 66a has six holes 68 serving to receive the upper portions of cylinders 69 as those of medical syringes; the pistons working in these cylinders have at their upper ends an integrally formed ring 70 preloaded by a weight 71 by means of a thread or wire 72 passed through the aperture of ring 70 and attached to a protrusion 66b of wing 66a. The narrowed lower end portion of each cylinder is lodged in one of the holes provided in the inclined portion 66c; it carries, as in syringes, a removable nipple for connection with one end of one of flexible hoses 73. The other end of the hoses 73 is connected with respective ones of passages 74 provided in a connecting piece or housing 75 so as to converge in same to a point located in a mixing chamber 76. This chamber 76 is in open flow connection with a pick-up hole 77 opening into the colorant inlet hole of the spray gun to which piece 75 can be affixed in any suitable manner, for example, by screwing. The upper end portion of each of the hoses 73 extends between a pair of juxtaposed legs 67a, 67b of the sheet-metal element 67. Leg 67a is sub-divided by slots 67c into six resiliently flexible tongues. Regulating screws 78 which can be manipulated in either direction in threaded holes adequately provided in a lower, foremost portion 66d of the sheet-metal element 66 make it possible for a user to more or less or even completely squeeze the hose 73 which extends behind same, through the intermediary of the corresponding tongue. Thus there are provided wholly independently actuable means for regulating the throughflow through each of the flexible hoses 73, in analogy to the metering valve described supra with reference to FIGS. 4 and 6.

This inexpensive embodiment keeps the advantage of enabling the user to perform a continuous change of any two or more of the colorants contained in fixe of the six cylinders 69; it also keeps the advantage of non-plugging of holes since no colorant-dry-up can intervene either in the blender or in the spray gun. Last but not least it keeps the advantage of an easy and rapid rinsing.

The embodiment now to be described with reference to FIGS. 12 to 16 provides hydraulic remote control of the colorant blender C (FIG. 12) by a manually actuatable control unit D operatively connected to the blender C by hydraulic means, whereby there is no need for electric power.

The main control unit D comprises cylinder-and-piston assemblies 80 (FIG. 15) which are actuatable by the fingers of one hand of a user, pressing one of the resilient tongues 81 of unit D, which tongues 81 are integral portions of a hand rest 82 made, e.g. of polyester. Eventually strips 83 of spring steel may be integrated to improve the resiliency of the hand rest 82 and the tongues 81 may then have transversal cuts at the places located below the finger articulations. There are five such tongues for controlling the metering respectively of the red, blue, yellow, white and black colorants. In the region of the hand palm a cut-out section 84 of the hand rest constitutes a press-button affixed to the outer end of the piston of a sixth cylinder-and-piston assembly 80; it serves to control the metering of the solvent.

The hand rest 82 is formed integrally with, or soldered to, a casing 85 secured at its bottom rim inwardly to ears 86*a* of base plate 86 by means of screws 86*b*. The cylinder-and-piston assemblies 80 may be affixed to the tongues 81 by screws 113 and to support joints 115.

Figure 13:
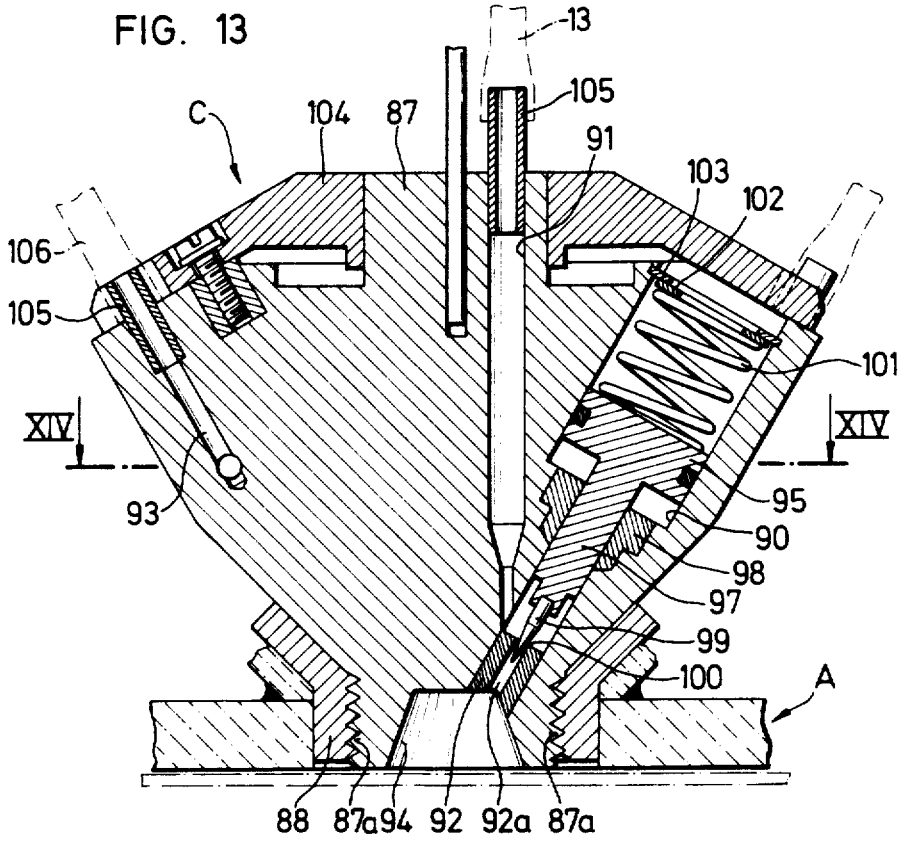
FIG. 13 is a longitudinal sectional view of the valve unit, taken along the line XIII—XIII of FIG. 14.
Figure 14:
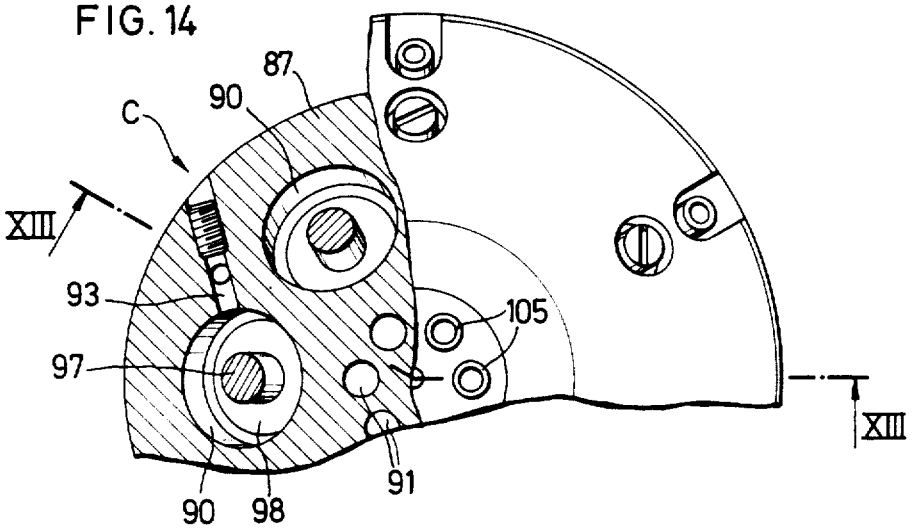
FIG. 14 is partly a top view of the valve unit, partly taken along the line XIV—XIV of FIG. 13.
Figure 15:
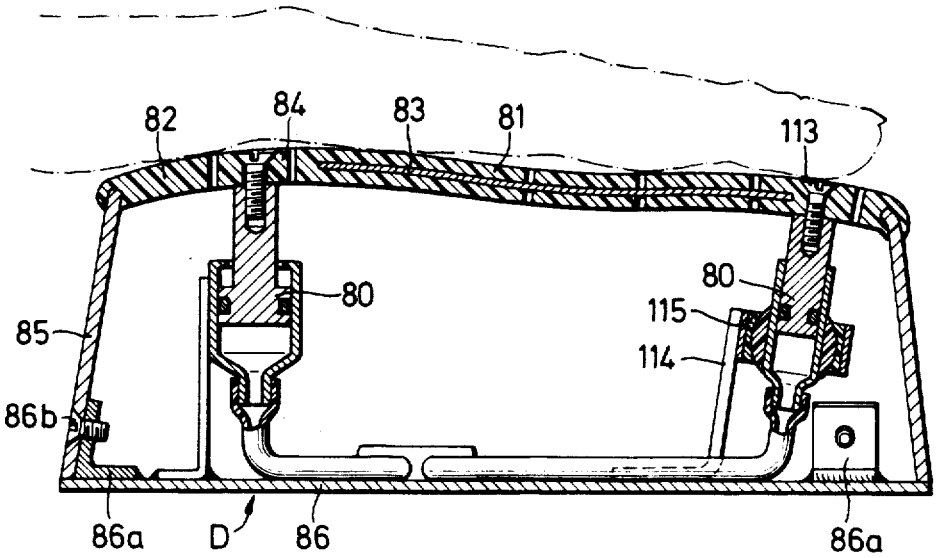
FIG. 15 is a longitudinal sectional view of the hydraulic control unit shown at the left of FIG. 12.

The colorant blender C illustrated in FIGS. 13 and 14 has a housing 87 with a threaded end portion 87*a* for screwing fixation to a sleeve 88 that may be soldered or adhesively bounded to the airbrush A at the generally provided colorant holding cup thereof. It is, however, clear that there might be provided fixation means similar, for example, to those shown in FIGS. 4 and 6.

The housing 87 has six circularly arranged stepped main bores 90 inclined to the axis of the housing. It also has bores as can be seen from FIGS. 13 and 14, namely six bores 91 which serve to the adduction of the individual colorants (and solvent), six bores 92*a* in bushings 92 for the outflow of the metered individual colorants (and solvent) to a central mixing chamber 94, and six bores 93 for the inflow and outflow of transmission liquid acting upon pistons 95 which work in the widest portion of the bores 90. The mixing chamber 94 is located next to a flowpath for the colorant blend in the airbrush surrounding its valve needle. Each of the pistons 95 is formed integral with a valve stem 97 sealingly guided in a ring 98 which in turn is sealingly fitted in a portion of bore 90. The valve stem 97 is fitted with a needle 99 serving as a valve closing member cooperating with a valve seat 100 provided on bushing 92. Each piston 95 is pre-loaded by a helical compression spring 101 resting on a disc 102 which in turn rests on a split ring 103 engaging a groove provided in the wall of bore 90. A cover 104 is fitted to housing 87 so as to close the bores 90. Short tube pieces 105 are inserted into the outer ends of bores 91, 93 for the connection of flexible hoses 13 and 106, the hoses 13 being as in the embodiments of FIGS. 1 to 3 and 6, those which serve the adduction of the individual colorants and of the solvent from the bags 11 or other containers, whilst the hoses 106 are connected to the individual cylinder-and-piston assemblies 80 of the control unit D.

The working mode of this embodiment is very simple: the user may hold the airbrush A for example with his right hand and act on one or more of the tongues 81 with the fingers of his other hand. By more or less depressing such a tongue 81 he causes the outflow of a more or less large quantity of transmission liquid into the corresponding bore 90 and, therefore, the retracting of the corresponding piston 95 and valve stem 97 against the force of spring 101, thereby more or less opening the metering valve constituted by this valve stem and the associated seat disk or valve seat 100.

Figure 16:
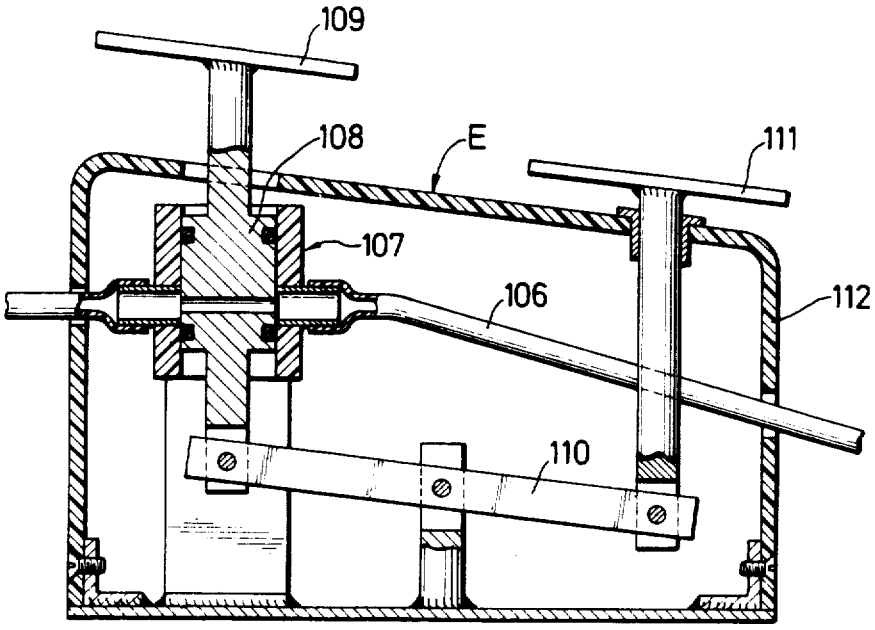
FIG. 16 is a longitudinal sectional view of the blocking unit shown in the bottom middle of FIG. 12.

It should be noted here that a very useful "hydraulic leverage" of for example 10:1 can be obtained by selecting for the piston area in the assemblies 80 a value which is ten times smaller than that of the ring area of the pistons 95, so that to lift the piston and stem by for example 1 mm the corresponding tongue 81 must be depressed by 10 mm; with such leverage the resistance of spring 101 may grow from 1.5 kg to 5 kg, whilst at the same time the force to be exerted on tongue 81 will grow from 0.15 kg to 0.5 kg. The leverage for the systems constituted by the cylinder-and-piston assembly 80 attached to press-button 84 and the piston and valve stem metering the throughflow of solvent may be selected to be for example, 1:1 so that the press-button 84 has to be depressed by only 1 mm to fully open the valve which governs the throughflow of solvent. The blocking unit indicated at E on FIG. 12 and shown in more detail in FIG. 16 is optional and comprises five simple slide cocks 107 fitted into the five hoses 106 used in the control of metering the colorants; the movable members 108 of these cocks are fixedly connected to respective pedals 109, and by means of associated two-arm levers 110, operatively connected to restoring pedals 111. The mechanisms are enclosed in a casing 112 shown to have a top wall sloping to one side in order to give the user "location indication" as to which one of the pedals 109 or 111 he is acting on. If he depresses one of the pedals 109 he shuts the corresponding slide cock 107, thereby blocking any flow of transmission liquid in the corresponding hose 106 in either direction. If he has previously performed a setting of the corresponding metering valve in the colorant blender this setting will then stay even if he ceases to act on the corresponding tongue 81, until he depresses fully the corresponding pedal 111 to fully open the corresponding slide cock 109.

Since some users may prefer a control unit D (possibly combined with a blocking unit E) to one in which (as in the embodiments of FIGS. 2, 3 or 6) setting potentiometers are used by acting on slides, the control unit D may be used to displace the potentiometer slides. The potentiometers may even be incorporated to the control unit D, together with springs (similar to springs 101) which provide a "finger pressure sensing".

It should be clear that such modifications, as well as many other rearrangements of parts or changes of details could be made within the scope of the present ivnention. For example, the axes of the metering valves and associated actuators as described with reference to FIGS. 4 and 6, and of the passages 74 as described with reference to FIG. 11 may extend in planes inclined to radial planes of housing 20, 21 or 2040 or 75. Also the embodiment of FIG. 6 might be modified so that the metering valves and their actuators would have axes parallel to the main axis of the housing. It would even be possible to arrange these axes in one single plane.

We claim:

1. A colorant blender interconnecting a plurality of colorant supply containers and a painting apparatus, comprising:

a housing having a predetermined longitudinal axis and containing a mixing chamber;

said housing comprising a first housing part provided with a plurality of bores for connection with the plurality of colorant supply containers;

said first housing part further containing a plurality of further bores opening into said mixing chamber through related valve seats;

each one of said plurality of bores opening into an associated one of said further bores close to said related valve seat;

a plurality of metering valves;

each one of said metering valves being accommodated by an associated one of said further bores and containing a metering valve needle;

said metering valve needles being arranged in said plurality of further bores at a predetermined inclination relative to said longitudinal axis of said housing and directed to a substantially common point of convergence located in said mixing chamber;

electrically operated actuating means individually associated with each one of said metering valves for longitudinally moving said metering valve needles in said associated further bores relative to said related valve seats and thereby carrying out metering operations for metering colorant from the associated colorant supply containers into said mixing chamber; and said housing further containing a second housing part for connection to a painting apparatus and containing an outlet duct connected to said mixing chamber.

2. The colorant blender as defined in claim 1, further including:

a control box operatively associated with said electrically operated actuating means;

said control box containing a plurality of selector members; and each one of said selector members being operatively connected with a related one of said electrically operated actuating means and being continuously adjustable for controlling the longitudinal movement of an associated one of said metering valve needles.

3. The colorant blender as defined in claim 2, wherein:

said control box is arranged separately from said housing; and said plurality of said selector members being arranged at said control box for one-handed selective finger-controlled adjustment.

4. The colorant blender as defined in claim 1, wherein:

one of said plurality of bores in said first housing part is provided for connection to a solvent container containing an appropriately selected solvent for dissolving the colorants metered by said plurality of metering valves.

5. The colorant blender as defined in claim 1, wherein:

said first housing part bounds said mixing chamber on one side thereof;

said second housing part bounding said mixing chamber on an other side thereof; and said first housing part and said second housing part being fixedly interconnected.

6. The colorant blender as defined in claim 5, wherein:

said second housing part bounds said mixing chamber by means of an approximately conically shaped wall converging towards said outlet duct.

7. The colorant blender as defined in claim 6, wherein:

said outlet duct extends substantially perpendicular to said longitudinal axis of said housing.

8. The colorant blender as defined in claim 1, wherein:

said plurality of further bores, said plurality of metering valves and their associated metering valve needles, and said plurality of valve seats being arranged in said first housing part in a substantially uniformly distributed manner around said longitudinal axis of said housing.

9. The colorant blender as defined in claim 1, wherein:

each one of said electrically operated actuating means comprises a rotary step motor arranged in said further bore of said first housing part;

said rotary step motor containing a rotor;

said rotor of said rotary step motor being threadingly connected to an associated metering valve needle;

said associated metering valve needle being held against rotation about its axis in said first housing part; and said metering valve needle being displaceable relative to said valve seat under the action of said rotary step motor in order to carry out said metering operation.

10. The colorant blender as defined in claim 1, wherein:

each one of said electrically operated actuating means constitutes a pulsed solenoid electromagnetically cooperating with an associated one of said metering valve needles;

means for spring loading said associated metering valve needle into closing engagement with its associated valve seat; and said metering valve needle being reciprocatingly movable in pulses between an open position and a closed position relative to said valve seat in order to thereby carry out said metering operation.

11. The colorant blender as defined in claim 1, wherein:

said housing contains connecting means for retrofittingly connecting the colorant blender to an airbrush in place of a conventional colorant-containing vessel.

12. An airbrush comprising:

a main needle valve for controlling the throughflow of paint through the airbrush;

sensor means sensing the position of said main needle valve and thereby the throughflow of paint through said airbrush;

throughflow adjusting means for adjusting the throughflow of paint through said airbrush;

a colorant blender interconnecting said airbrush and a plurality of colorant supply containers;

said colorant blender comprising:

a housing having a predetermined longitudinal axis and containing a mixing chamber;

said housing comprising a first housing part provided with a plurality of bores for connection with the plurality of colorant supply containers;

said first housing part further containing a plurality of further bores opening into said mixing chamber through related valve seats;

each one of said plurality of bores opening into an associated one of said plurality of further bores close to said related valve seats;

a plurality of metering valves;

each one of said plurality of metering valves being accommodated by an associated one of said further bores and containing a metering valve needle;

said metering valve needles being arranged in said plurality of further bores at a predetermined inclination relative to said longitudinal axis of said housing and directed to a substantially common point of convergence located in said mixing chamber;

electrically operated actuating means individually associated with each one of said metering valves for longitudinally moving said metering valve needles in said associated further bores relative to said related valve seats and thereby carrying out metering operations for metering colorant from the associated colorant supply containers into said mixing chamber;

said housing further containing a second housing part for connection to the airbrush and containing an outlet duct connected to said mixing chamber;

said electrically operated actuating means controlling said metering operation of said metering valve needles such as to produce a total metered throughflow metered by said metering valve; and said sensor means being operatively associated with said electrically operated actuating means such that said total metered throughflow metered by said metering valves is at least approximately equal to said throughflow of paint through said airbrush controlled by said main needle valve.

* * * * *

UNITED STATES PATENT AND TRADEMARK OFFICE

CERTIFICATE OF CORRECTION

PATENT NO. : 4,723,712

DATED : FEBRUARY 9, 1988

INVENTOR(S) : JEAN EGLI et al

It is certified that error appears in the above-identified patent and that said Letters Patent is hereby corrected as shown below:

Column 2, line 12, please delete "em-"

Column 2, line 13, please delete "bodiments" and insert --embodiments--

Column 2, line 30, please delete "choise" and insert --choice--

Column 5, line 67, after "of" (first occurrence) please delete "olne" and insert --one--

Column 10, line 55, after "or" (first occurrence) please delete "2040" and insert --20'--

Signed and Sealed this

Fifth Day of July, 1988

*Attest:*

*Attesting Officer*

DONALD J. QUIGG

*Commissioner of Patents and Trademarks*